United States Patent [19]

Sheetz

[11] 3,970,267

[45] July 20, 1976

[54] REEL WITH INTERCHANGEABLE PARTS

[75] Inventor: George A. Sheetz, Summerville, S.C.

[73] Assignee: Larry Harold Kline, Charleston, S.C.

[22] Filed: Nov. 11, 1974

[21] Appl. No.: 522,573

[52] U.S. Cl. ..... 242/115; 242/118.4

[51] Int. Cl.[2] ..... B65H 75/22; B65H 75/14

[58] Field of Search... 242/115, 118.4, 118.6–118.8, 242/125.1, 77, 85; 191/12.2 R, 12.2 A

[56] References Cited

UNITED STATES PATENTS

| | | | |
|---|---|---|---|
| 1,264,918 | 5/1918 | Green | 242/77 |
| 1,747,486 | 2/1930 | Ridgway | 116/DIG. 41 |
| 1,784,236 | 12/1930 | Jones | 116/DIG. 41 |
| 3,128,857 | 4/1964 | Walton | 191/12.2 R |
| 3,284,021 | 11/1966 | Ryll et al. | 242/118.6 |
| 3,536,275 | 10/1970 | Saloman | 242/85 |
| 3,717,315 | 2/1973 | Kovaleski | 242/115 |

*Primary Examiner*—Leonard D. Christian
*Attorney, Agent, or Firm*—Larry Harold Kline

[57] ABSTRACT

A reel for storing cabled material is disclosed, comprising first and second central section pieces which are nestable and interchangeable, and first and second end pieces which are stackable and interchangeable.

21 Claims, 3 Drawing Figures

REEL WITH INTERCHANGEABLE PARTS

This invention relates to reels and more particularly to reels used for storage of cabled material.

Reels presently used for storing cabled material are generally bulky, heavy and difficult to repair and store. Wooden reels now are customarily not re-used, but are burned, broken up, or simply left to rot at various sites. Storage of the wooden reels is expensive and inconvenient.

The present invention solves many basic problems incurred by use of the wooden reels. By using the present invention, reels are available which are nestable, when empty; easily storable, when full; durable; easily repaired or replaced; permanently color-coded; stronger and lighter than wooden reels; and easily manufactured and shipped.

This specification discloses two distinct innovations with regard to reels. One of these innovations is claimed in detail in this patent application and the other is claimed in a simultaneously-filed patent application by the same inventor. Both of these innovations will be discussed in this specification.

An object of the present invention is to provide a reel with interchangeable parts for storing cabled material.

A further object of this invention is to provide a reel which is stronger and lighter than wooden reels.

A further object of this invention is to provide a reel which would require a minimum of storage space and a maximum of physical stability while being stored.

Still a further object of this invention is to provide a reel with parts that can nest for storage and shipping purposes.

Another object of this invention is to provide a reel which is re-useable and returnable.

Another object of this invention is to provide a reel which would reduce the overall expense in the use of cable reels.

A further object of this invention is to provide a reel which could be pigmented for a permanent color coding which would not wear off or be painted over.

These and other objects and features of the invention will be apparent from the following description and appended claims.

Briefly, the first of the two distinct innovations with regards to reels is a reel for storing cabled material comprising a first reel half, a second reel half and securing means holding the first reel half to the second reel half. The first reel half may comprise a first disk and a first cabled material holding section attached to the first disk. The outside diameter of the larger diameter portion of the first cabled material holding section is smaller than the diameter of the first disk. The second reel half may comprise a second disk and a second cabled material holding section attached to the second disk. The outside diameter of the larger diameter portion of the second cabled material holding section is smaller than the diameter of the second disk. The first cabled material holding section comprises a first hole with the diameter larger than the diameter of the cabled material, whereby the cabled material may fit through the hole. The first cabled material holding section may have the shape of the frustum of a first cone with a larger diameter edge and a smaller diameter edge, with the larger diameter edge being attached to the first disk and the smaller diameter edge having a first bottom piece attached. The second cabled material holding section may be in the shape of the frustum of a second cone with a larger diameter edge and a smaller diameter edge, with the larger diameter edge being attached to the second disk, and the smaller diameter edge having a second bottom piece affixed. A first convex extension may be attached to the first bottom piece of the frustum of a first cone. A first concave indentation of similar size as the first convex extension may be indented into the first bottom piece of the frustum of a first cone at a point 180° from the first convex extension. A second convex extension may be attached to the second bottom piece of the frustum of a second cone. A second concave indentation of similar size as the second convex extension may be indented into the second bottom piece of the frustum of a second cone at a point 180° from the second convex extension. The first disk may comprise an opening having a diameter larger than the diameter of the smaller diameter edge of the frustum of a first cone. The opening in the first disk may have a diameter that is not greater than the larger diameter edge of the frustum of a first cone. The opening in the first disk may have a diameter equal to the diameter of the larger diameter edge of the frustum of a first cone. The second disk may comprise an opening having a diameter larger than the diameter of the smaller diameter edge of the frustum of a second cone. The opening in the second disk may have a diameter that is not greater than the larger diameter edge of the frustum of a second cone. The opening in the second disk may have a diameter equal to the diameter of the larger diameter edge of the frustum of a second cone. The first disk may comprise a plurality of indentations. The securing means may comprise a plurality of first braces, a plurality of second braces, and a plurality of bolting means. When the first reel half is mated to the second reel half, the plurality of first braces may be placed against the first reel half, and the plurality of second braces may be placed against the second reel half, with the plurality of bolting means passing through the plurality of first braces, the first reel half, the second reel half, and the plurality of second braces, and being bolted, thereby securing the first reel half to the second reel half to form a reel operative to store the cabled material. When the first reel half is mated to the second reel half, the first bottom piece of the frustum of a first cone may rest against the second bottom piece of the frustum of a second cone. The first convex extension may rest in the second concave indentation. The second convex extension may rest in the first concave indentation. The first disk may comprise a plurality of first indentations. The second disk may comprise a plurality of second indentations. The plurality of first braces may be placed in the plurality of first indentations. The plurality of second braces may be placed in the plurality of second indentations. The plurality of bolting means may comprise a plurality of bolts threaded at each end and a plurality of nuts fitting the plurality of bolts. The plurality of bolts may pass through the plurality of first braces, the first reel half, the second reel half, and the plurality of second braces. Each of the plurality of bolts may then be secured on each of its ends by one of the plurality of nuts. The cabled material may be passed through the first hole in the first cabled material holding section and attached to the first disk. The cabled material may then be spindled over the first cabled material holding section and the second cabled material holding section. The first reel half may nest for storage and shipping purposes on the second reel half. The first reel half and the second reel half may be permanently color-coded for various purposes. The first reel half and the second reel half may be substantially identical and may be interchanged. The first reel half and the second reel half may be manufactured from any synthetic material.

Briefly, the second distinct innovation with regard to reels is a reel for storing cabled material comprising a first central section piece, a second central section piece, which may be placed against the first central section piece to form a center portion with two ends, a first end piece to which one of the two ends of the center portion may be pressed, a second end piece, to which the other of the two ends of the center portion may be pressed, and holding means operative to hold the first central section piece, the second central section piece, the first end piece, and the second end piece pressed together. The first central section piece and the second central section piece may be substantially identical and interchangeable. The first end piece and the second end piece may be substantially identical and interchangeable. The first central section piece and the second central section piece may be half cylinders which when pressed together form a cylinder. Each end disk may comprise an indented circular slot, whereby either end of the cylinder formed by pressing the half cylinders together, will fit into the slot. Each end disk may comprise a plurality of supporting ribs and a supporting rim. Each slot may further act as a supporting ridge. The first central section piece and the second central section piece may each contain a plurality of holes, with a diameter larger than the diameter of the cabled material, whereby the cabled material may fit through the plurality of holes. The first end piece and the second end piece may each contain a plurality of holes, with a diameter larger than the diameter of the cabled material, whereby the cabled material may fit through the plurality of holes. Each end disk may contain a plurality of openings for the holding means to pass through. The holding means may comprise a bolt of sufficient length to pass through the cylinder and both of the end disks, with the bolt having a head of a diameter larger than the diameter of the plurality of openings in each end disk. The holding means may further comprise a nut operative to hold the bolt and therefore to hold each end disk to the cylinder, and a plurality of washers operative to aid the bolt and the nut to hold each end disk to the cylinder. The first central section piece may nest into the second central section piece for storage or shipping purposes. The first end piece may be stacked onto the second end piece for storage or shipping purposes. The first central section piece, the second central section piece, the first end piece, or the second end piece may be manufactured from any strong, lightweight material such as fiberglass reinforced plastic, or any synthetic material. The reel may be permanently color-coded for various purposes. The permanent color-coding may be accomplished by impregnating material with pre-designated pigment. The bolt may be hollow so that the reel may be mountable on a reel spindle for various reeling purposes.

The invention will be more fully understood from the following detailed description and appended claims.

Figure 1:
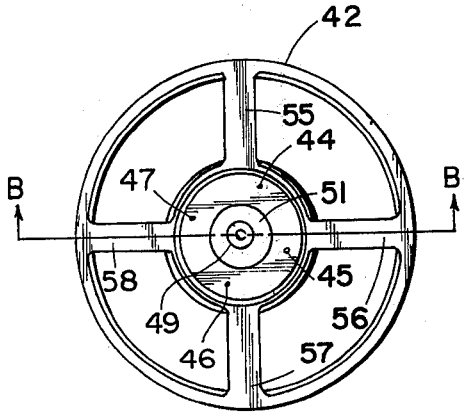
FIG. 1 is an end view of a reel which comprises two section pieces and two end pieces for storing cabled material.

FIG. 1 is an end view of a reel which comprises two central section pieces and two end pieces for storing cabled material. FIG. 1 shows a first end piece or end disk 42. End disk 42 has supporting ribs 55, 56, 57, and 58. End disk 42 has holes 44, 45, 46, and 47. Holes 44, 45, 46, and 47 are of a diameter larger than the diameter of the cabled material to be spindled, and the cabled material will fit through the holes. Head 49 of bolt 48, (which is shown in FIG. 3), is shown pressed against washer 51.

Figure 2:
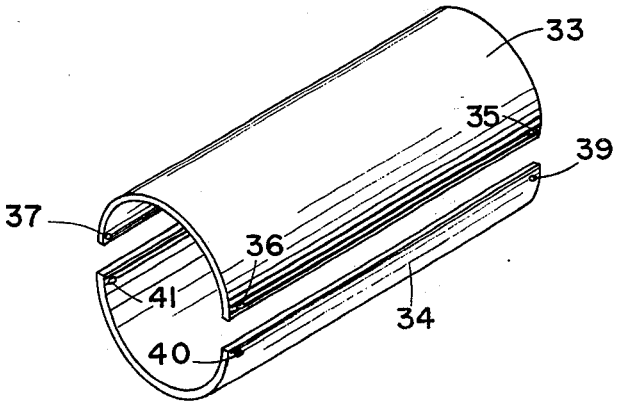
FIG. 2 is an isometric view of two central section pieces.

FIG. 2 is an isometric view of two central section pieces. Central section piece 33 is a half-cylinder. Central section piece 34 is an identical half-cylinder to half-cylinder 33. Half-cylinder 33 has holes 35, 36, 37, and 38, (shown in FIG. 3). Half-cylinder 34 has holes 39, 40, 41, and one hole not shown which is located in a position diametrically opposite to hole 39.

Figure 3:
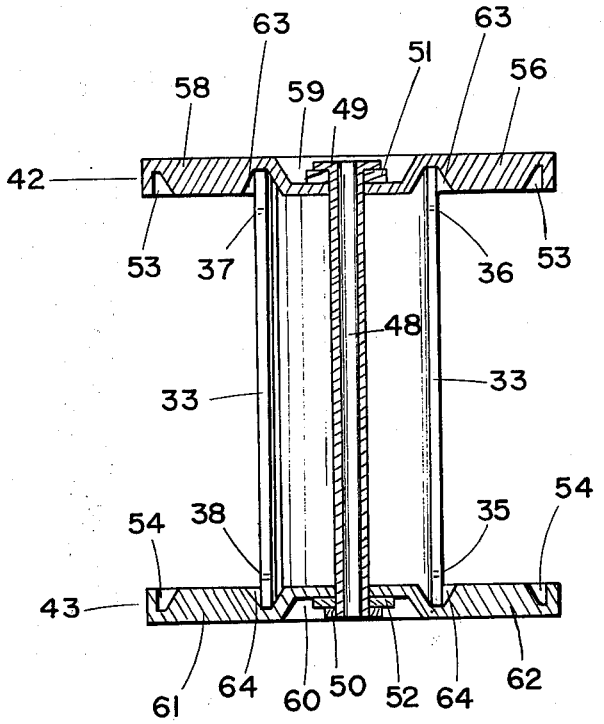
FIG. 3 is a cross-sectional view of plane B—B of FIG. 4.

FIG. 3 is a cross-sectional view of plane B—B of FIG. 1. The reel shown in FIG. 1 comprises a first central section piece 34, a second central section piece 33, which is pressed against first central section piece 34 to form a center portion with two ends. The two ends are pressed into slots in two end pieces, and held together by holding means. FIG. 3 shows a cross-section showing central section piece 33 with the ends of central section piece 33 pressed into slot 63 in end disk 42, and slot 64 in end disk 43. Slots 63 and 64 also serve as supporting ridges for the ends of central section pieces 33 and 34. End disk 42 has a supporting rim 53 and inner hub 59, along with slot 63. End disk 43 has a supporting rim 54 and inner hub 60, along with slot 64. Bolt 48 is shown extending through central section piece 33 and central section piece 34. Head 49 of bolt 48 presses against washer 51, which presses against end disk 42. Nut 50 presses against washer 52, which presses against end disk 43. Bolt 48, nut 50 and washers 51 and 52 comprise the holding means for the reel, and hold together end disk 42, end disk 43, half-cylinder 33, and half-cylinder 34, thereby forming the reel.

Disk 43 has supporting ribs 61 and 62, along with two other supporting ribs not shown, which are similar to supporting ribs 55, 56, 57 and 58 of end disk 42. Central section piece or half-cylinder 33 is substantially identical and interchangeable with central section piece or half-cylinder 34. End piece or end disk 42 is substantially identical and interchangeable with end disk or end piece 43. Central section piece 33, central section piece 34, end disk 42, and end disk 43 all contain a plurality of holes with the diameter larger than the diameter of the cabled material, whereby the cabled material may fit through the plurality of holes in either half-cylinder 33 or half-cylinder 34, and pulled through any of the plurality of holes of end disk 42 or end disk 43, and fastened or stapled by any means to end disk 42 or end disk 43. The cabled material may be fastened in the inner hub 59 of end disk 42 or the inner hub 60 of end disk 43, where the fastened cabled material will have no effect on the physical stability of the reels if they are stacked one on top of the other when loaded with cabled material. The cabled material fastened in inner hub 59 and inner hub 60 will not be above the plane formed by the outer area of the various supporting ribs, which will be in contact with other supporting ribs if and when the filled reels are stacked.

Head 49 of bolt 48 and the nut 50, along with the washers will all be contained in the inner hubs so as not to interfere with the stacking of the reels.

Central section piece 33 will nest into central section piece 34 for storage or shipping purposes. End disk 42 will stack onto end disk 43 for storage or shipping purposes. Central section piece 33, central section piece 34, end piece 42 or end piece 43 may be manufactured from any strong lightweight material such as fiberglass-reinforced plastic, or from any synthetic material, and may be permanently color-coded for various purposes by any means, including impregnating material with pre-designated pigment. For example, different colored pigments can indicate different sizes of cabled materials or any other coded message desired by the users of the invention.

Bolt 48 may be hollow so that the reel may be mountable on a reel spindle for various reeling purposes.

Half-clyinders 33 and 34 have the same length and the same radius. Disks 42 and 43 are identical. Half-cylinders 33 and 34 may be pressed together to form a cylinder. The cylinder sits into the indented circular slot in each disk, aiding in preventing the cylinder from slipping on the disk. The disk itself has reinforcing ribs and the indentation which accommodates the cylinder also acts as a reinforcing ridge.

At the outer circumference of each of the disks, the disk is molded in such a way as to provide a reinforced rim. The reinforcement helps to maintain the integrity of the rim when the reel is rolled or placed onto the floor with the weight of a cable or wire on it. When the cylinder is placed in between two disks, the two disks are compressed by holding means which may be bolts, or which could be any type of holding means.

Both of the reels discussed in this specification, one of which is claimed in this Patent Application, meet the goals of the objects as previously discussed. Both reels are nestable when empty, easily storable when full. The reels are made of durable material and may be easily repaired or replaced. They may be permanently color-coded. They are stronger and lighter than wooden reels and may be easily manufactured and shipped.

If one central section piece is damaged, it may be replaced by simply another central section piece. If one end piece is damaged it may be replaced by another end piece. If one reel half is damaged, it may be replaced by another reel half. All of these features add to easy repair and replacement, and to a reel with interchangeable parts, that can nest for storage and shipping purposes, that is reusable and returnable, that requires a minimum of storage space and a maximum of physical stability while being stored, that can be pigmented for permanent color-coding, and that will reduce the overall expense in the use of cabled reels.

While the invention has been described with reference to specific embodiments, the description is illustrative and is not to be construed as limiting the scope of the invention. Various modifications and changes may occur to those skilled in the art, without departing from the spirit and the scope of the invention as defined by the appended claims.

I claim:

1. A reel for storing cabled material comprising:

a. a first central section piece;

b. a second central section piece which may be pressed against, but is not mechanically fastened to, said first central section piece to form a center portion with two ends;

c. a first end piece to which one of said two ends of said center portion may be pressed, but is not mechanically fastened to;

d. a second end piece to which the other of said two ends of said center portion may be pressed, but is not mechanically fastened to;

e. holding means operative to hold said first central section piece, said second central section piece, said first end piece, and said second end piece, pressed together.

2. A reel according to claim 1 wherein said first central section piece and said second central section piece are substantially identical and are interchangeable.

3. A reel according to claim 1 wherein said first end piece and said second end piece are substantially identical and interchangeable.

4. A reel according to claim 2 wherein said first end piece and said second end piece are substantially identical and interchangeable.

5. A reel according to claim 2 wherein said first central section piece and said second central section piece are half cylinders which when pressed together form a cylinder.

6. A reel according to claim 3 wherein said first central section piece and said second central section piece are half cylinders which when pressed together form a cylinder.

7. A reel according to claim 6 wherein said first and second end pieces are end disks.

8. A reel according to claim 7 wherein each end disk comprises an indented circular slot whereby either end of said cylinder formed by pressing said half cylinders together will fit into said slot.

9. A reel according to claim 8 wherein each end disk further comprises a plurality of supporting ribs and a supporting rim.

10. A reel according to claim 9 wherein said slot further acts as a supporting ridge.

11. A reel according to claim 2 wherein said first central section piece and said second central section piece each contain a plurality of holes with a diameter larger than the diameter of said cabled material, whereby said cabled material may fit through said plurality of holes.

12. A reel according to claim 3 wherein said first end piece and said second end piece each contain a plurality of holes with a diameter larger than the diameter of said cabled material, whereby said cabled material may fit through said plurality of holes.

13. A reel according to claim 4 wherein said first end piece and said second end piece contain a plurality of holes with a diameter larger than the diameter of said cabled material, whereby said cabled material may fit through said plurality of holes.

14. A reel according to claim 10 wherein said each end disk contains a plurality of openings for said holding means to pass through.

15. A reel according to claim 14 wherein said holding means comprises:

a. a bolt of sufficient length to pass through said cylinder and both of said end disks, with said bolt having a head of a diameter larger than the diameter of one of said plurality of openings in said each end disk;

b. a nut operative to hold said bolt and therefore hold said each end disk to said cylinder;

c. a plurality of washers operative to aid said bolt and said nut to hold said each end disk to said cylinder.

16. A reel according to claim 1 wherein said first central section piece will nest into said second central section piece for storage or shipping purposes.

17. A reel according to claim 1 wherein said first end piece may be stacked onto said second end piece for storage or shipping purposes.

18. A reel according to claim 1 wherein said first central section piece, said second central section piece, said first end piece, or said second end piece may be manufactured from any strong, lightweight material, such as fiberglass-reinforced plastic.

19. A reel according to claim 1 wherein said first central section piece, said second central section piece, said first end piece, or said second end piece, may be permanently color-coded for various purposes.

20. A reel according to claim 19 wherein said first central section piece, said second central section piece, said first end piece, or said second end piece, may be permanently color-coded by impregnating material with pre-designated pigment.

21. A reel according to claim 15 wherein said bolt is hollow whereby said reel is mountable on a reel spindle for various reeling purposes.

* * * * *